US009047803B2

(12) United States Patent
Lee et al.

(10) Patent No.: US 9,047,803 B2
(45) Date of Patent: Jun. 2, 2015

(54) DISPLAY APPARATUS INCLUDING BI-DIRECTIONAL GATE DRIVE CIRCUIT

(75) Inventors: Jae-Hoon Lee, Seoul (KR); Chang-Ho Lee, Seoul (KR); Jun-Yong Song, Seongnam-si (KR); Yu-Han Bae, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 386 days.

(21) Appl. No.: 13/274,939

(22) Filed: Oct. 17, 2011

(65) Prior Publication Data

US 2012/0162187 A1 Jun. 28, 2012

(30) Foreign Application Priority Data

Dec. 24, 2010 (KR) ..... 10-2010-0134225

(51) Int. Cl.
*G09G 3/36* (2006.01)
*G09G 3/00* (2006.01)
*G09G 3/29* (2006.01)

(52) U.S. Cl.
CPC ..... *G09G 3/007* (2013.01); *G09G 3/29* (2013.01); *G09G 2300/0838* (2013.01); *G09G 2300/0871* (2013.01); *G09G 2310/0286* (2013.01); *G09G 2310/0289* (2013.01)

(58) Field of Classification Search
USPC ..... 345/212, 213
See application file for complete search history.

(56) References Cited

U.S. PATENT DOCUMENTS

| | | | | |
|---|---|---|---|---|
| 5,952,854 | A | 9/1999 | Kubota et al. | |
| 7,327,343 | B2 | 2/2008 | Lu et al. | |
| 2006/0256066 | A1 * | 11/2006 | Moon | 345/100 |
| 2007/0171115 | A1 | 7/2007 | Kim et al. | |
| 2008/0067511 | A1 * | 3/2008 | Kim | 257/59 |
| 2008/0219401 | A1 * | 9/2008 | Tobita | 377/79 |
| 2009/0189679 | A1 * | 7/2009 | Lee et al. | 327/436 |
| 2010/0026669 | A1 | 2/2010 | Lee et al. | |
| 2010/0260312 | A1 * | 10/2010 | Tsai et al. | 377/79 |
| 2010/0277206 | A1 * | 11/2010 | Lee et al. | 327/108 |
| 2013/0038587 | A1 * | 2/2013 | Song et al. | 345/211 |

* cited by examiner

*Primary Examiner* — Kwang-Su Yang
(74) *Attorney, Agent, or Firm* — Cantor Colburn LLP

(57) ABSTRACT

A gate drive circuit includes a plurality of driving stages. An n-th ('n' is a natural number) driving stage includes a pull-up part, a carry part, a first pull-down part, a first pull-up/down control part and a second pull-up/down control part. The first pull-up/down control part applies a first power signal of an ON voltage to a control terminal of the pull-up part in a forward direction mode, and applies the first power signal of a second OFF voltage to a control terminal of the pull-up part in a reverse direction mode. The second pull-up/down control part applies a second power signal of the second OFF voltage to the control terminal of the pull-up part in the forward direction mode, and applies the second power signal of the ON voltage to the control terminal of the pull-up part in the reverse direction mode.

19 Claims, 9 Drawing Sheets

DISPLAY APPARATUS INCLUDING BI-DIRECTIONAL GATE DRIVE CIRCUIT

This application claims priority to Korean Patent Application No. 2010-134225, filed on Dec. 24, 2010, and all the benefits accruing therefrom under 35 U.S.C. §119, the contents of which in its entirety is herein incorporated by reference.

BACKGROUND OF THE INVENTION

1. Field of the Invention

Exemplary embodiments of the present invention relate to a gate drive circuit and a display apparatus having the gate drive circuit. More particularly, exemplary embodiments of the present invention relate to a gate drive circuit that is bi-directionally driven and a display apparatus having the gate drive circuit.

2. Description of the Related Art

In order to decrease a size of a liquid crystal display (LCD) apparatus and to enhance a productivity of the LCD apparatus, an amorphous silicon gate (ASG) technology that integrates the gate drive circuit on a display panel is typically employed. When the gate drive circuit is directly formed on the display panel, the gate drive circuit sequentially outputs a plurality of gate signals.

When a printed circuit board (PCB) is disposed on an upper long side of the display panel, a driving signal for driving the gate drive circuit is applied to an upper portion of the gate drive circuit, and the gate drive circuit sequentially outputs gate signals in a direction proceeding from an upper portion of the display panel to a lower portion of the display panel.

When the PCB is disposed on a lower long side of the display panel, a driving signal for driving the gate drive circuit is applied to a lower portion of the gate drive circuit, and the gate drive circuit sequentially outputs gate signals in a direction proceeding from a lower portion of the display panel to an upper portion of the display panel. When gates signal outputs proceed from the lower portion to the upper portion, the display panel generally does not display a normal image.

BRIEF SUMMARY OF THE INVENTION

Exemplary embodiments of the present invention provide a gate drive circuit that is bi-directionally driven.

Exemplary embodiments of the present invention also provide a display apparatus having the above-mentioned gate drive circuit.

According to one aspect of the present invention, a gate drive circuit includes a signal circuit in which a plurality of driving stages is coupled to each other sequentially. The plural driving stages respectively output a plurality of gate signals to first terminals of plural gate lines. An n-th ('n' is a natural number) driving stage includes a pull-up part, a carry part, a first pull-down part, a first pull-up/down control part and a second pull-up/down control part. The pull-up part is configured to output an ON voltage of a first clock signal as an ON voltage of an n-th gate signal. The carry part is configured to output an ON voltage of the first clock signal as an ON voltage of an n-th carry signal. The first pull-down part is configured to pull-down an ON voltage of the n-th gate signal into a first OFF voltage in response to at least one output signal of a previous driving stage and at least one output signal of a following driving stage. The first pull-up/down control part is configured to apply a first power signal of an ON voltage to a control terminal of the pull-up part in a forward direction mode, and to apply a first power signal of a second OFF voltage to the control terminal of the pull-up part in a reverse direction mode, in response to at least one output signal of a previous driving stage. The second pull-up/down control part is configured to apply a second power signal of the second OFF voltage to the control terminal of the pull-up part in the forward direction mode, and to apply a second power signal of an ON voltage to the control terminal of the pull-up part in the reverse direction mode, in response to at least one output signal of a following driving stage.

According to another aspect of the present invention, a display apparatus includes a display panel, a main drive circuit and a gate drive circuit. The display panel includes a display area on which gate lines and data lines cross with each other and are formed to display an image and a peripheral area surrounding the display area. The main drive circuit is configured to generate a first power signal and a second power signal in accordance with a forward direction mode and a reverse direction mode. The gate drive circuit includes a signal circuit in which plural driving stages are sequentially coupled to each other. The plural driving stages respectively output a plurality of gate signals to first terminals of the gate lines. An n-th ('n' is a natural number) driving stage includes a pull-up part, a carry part, a first pull-down part, a first pull-up/down control part and a second pull-up/down control part. The pull-up part is configured to output an ON voltage of a first clock signal as an ON voltage of an n-th gate signal. The carry part is configured to output an ON voltage of the first clock signal as an ON voltage of an n-th carry signal. The first pull-down part is configured to pull-down an ON voltage of the n-th gate signal into a first OFF voltage in response to at least one output signal of a previous driving stage and at least one output signal of a following driving stage. The first pull-up/down control part is configured to apply a first power signal of an ON voltage to a control terminal of the pull-up part in a forward direction mode, and to apply a first power signal of a second OFF voltage to the control terminal of the pull-up part in a reverse direction mode, in response to at least one output signal of a previous driving stage. The second pull-up/down control part is configured to apply a second power signal of the second OFF voltage to the control terminal of the pull-up part in the forward direction mode, and to apply a second power signal of an ON voltage to the control terminal of the pull-up part in the reverse direction mode, in response to at least one output signal of a following driving stage.

According to some example embodiments of the present invention, a gate drive circuit may sequentially generate gate signals in a forward direction or a reverse direction, and may enhance a reliability of the gate signals.

BRIEF DESCRIPTION OF THE DRAWINGS

The above and other features and advantages of the present invention will become more apparent by describing in further detail exemplary embodiments thereof with reference to the accompanying drawings, in which.

DETAILED DESCRIPTION OF THE INVENTION

Figure 1:
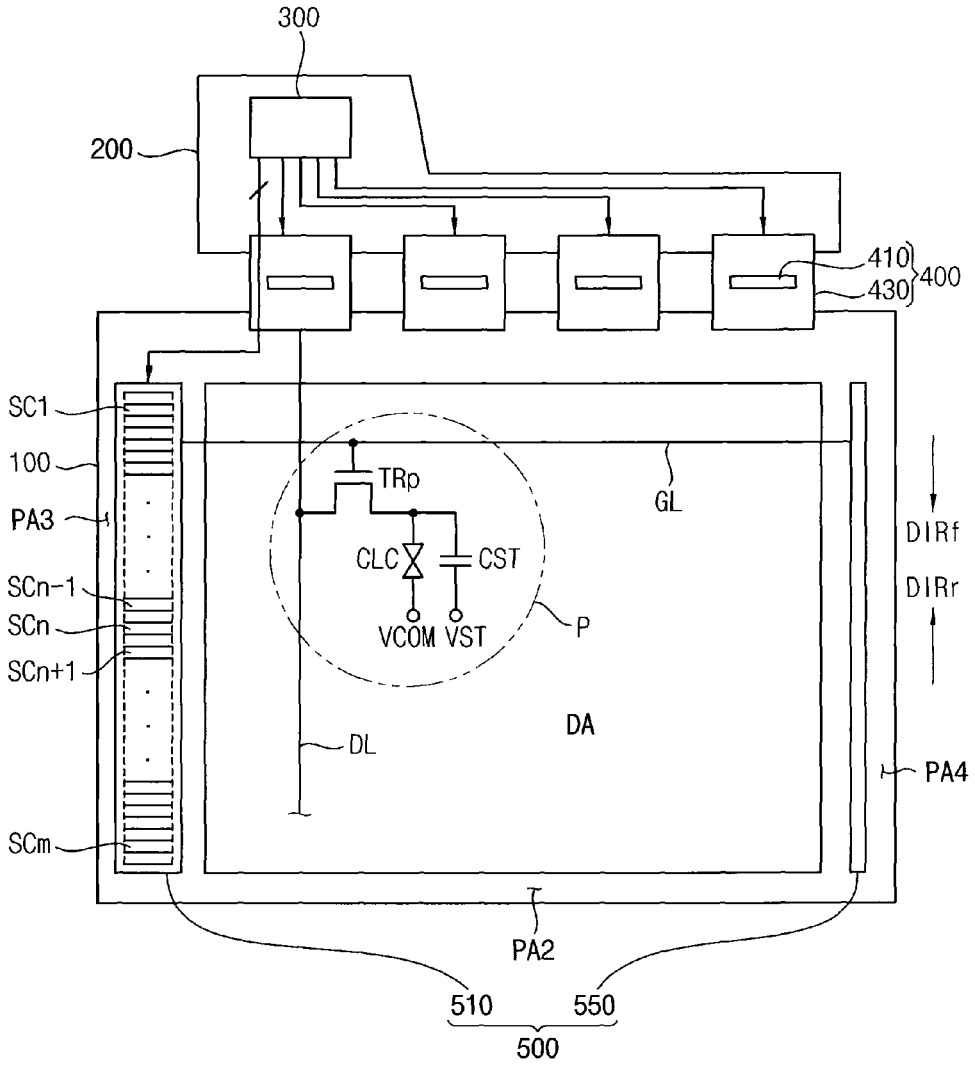
FIG. 1 is a plan view illustrating an exemplary embodiment of a display apparatus according to the present invention.

The present invention now will be described more fully hereinafter with reference to the accompanying drawings, in which various embodiments are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on" another element or layer, it can be directly on the other element or layer or intervening elements may be present therebetween. In contrast, when an element is referred to as being "directly on," another element, there are no intervening elements present. As used herein, the term "and/or" includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross-section illustrations that are schematic illustrations of idealized exemplary embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

FIG. 1 is a plan view illustrating an exemplary embodiment of a display apparatus according to the present invention.

Referring to FIG. 1, the display apparatus includes a display panel 100, a printed circuit board (PCB) 200, a main drive circuit 300, a data drive circuit 400 and a gate drive circuit 500.

The display panel 100 includes a display area DA and a plurality of peripheral areas surrounding the display area DA. The peripheral areas include a first peripheral area PA1, a second peripheral area PA2, a third peripheral area PA3 and a fourth peripheral area PA4. A plurality of gate lines GL, a plurality of data lines DL crossing the gate lines and a plurality of pixels are formed on the display area DA. Each of the plurality of pixels P includes a pixel switching element TRp, a liquid crystal capacitor CLC and a storage capacitor CST. The pixel switching element TRp is coupled to a gate line of the plurality of gate lines GL and a data line of the plurality of data lines DL. The liquid crystal capacitor CLC is electrically coupled to the pixel switching element TRp. The storage capacitor CST and the liquid crystal capacitor CLC are coupled to each other in parallel.

The PCB 200 includes the main drive circuit 300. The main drive circuit 300 generates a plurality of driving signals for driving the data drive circuit 400 and the gate drive circuit 500. The PCB 200 can be mounted on the first peripheral area PA1 or on the second peripheral area PA2 facing the first peripheral area PA1. The PCB 200 is typically denoted as a TOP-PCB type when the PCB 200 is mounted on the first peripheral area PA1 and as a BOTTOM-PCB type when the PCB 200 is mounted on the second peripheral area PA2. The main drive circuit 300 generates driving signals dependent on a mounting position of the PCB 200. For a TOP-PCB type, a frame image is scanned on the display panel 100 in a forward direction DIRf and for a BOTTOM-PCB type, the frame image is scanned on the display panel 100 in a reverse direction DIRr.

The data drive circuit 400 includes a source driving chip 410 outputting data signals to data lines DL and a flexible circuit board 430 mounted on the source driving chip 410 to electrically couple the PCB 200 to the display panel 100. In one embodiment, the source driving chip 410 is mounted on the flexible circuit board 430. Alternatively, the source driving chip 410 can be directly mounted on a peripheral area of the display panel 100. Transistors configuring the source driving chip 410 can be formed on the peripheral area when the pixel switching element TRp is formed.

The gate drive circuit 500 includes a signal circuit 510 and a discharging circuit 550.

The signal circuit 510 is disposed on the third peripheral area PA3 and corresponds to a first end portion of the gate lines GL and sequentially outputs gate signals of an ON voltage. The signal circuit 510 sequentially generates gate signals in a direction based on a driving signal provided from the main drive circuit 300 and in accordance with a mounting position of the PCB 200. For example, when the PCB 200 is mounted as the TOP-PCB type, the signal circuit 510 generates gate signals sequentially outputted in the forward direction DIRf (or a forward direction mode). When the PCB 200 is mounted as the bottom-PCB type, the signal circuit 510 generates gate signals sequentially outputted in the reverse direction DIRr (or a reverse direction mode). The signal circuit 510 includes a plurality of driving stages SC1, . . . , SCn−1, SCn, SCn+1, . . . , SCm (wherein, 'n' and 'm' are natural numbers, and 'n' is smaller than 'm'). Each of the driving stages includes a plurality of transistors. The transistors can be formed on the third peripheral area PA3 when the pixel switching element TRp is formed.

The discharging circuit 550 is disposed on the fourth peripheral area PA4 and corresponds to a second end portion of the gate lines GL and includes a plurality of transistors which discharge an ON voltage applied to the gate lines GL to a low voltage. The transistors of the discharging circuit 550 can be formed on the fourth peripheral area PA4 at the time that the pixel switching element TRp is formed. The discharging circuit 550 sequentially discharges the ON voltage of the gate lines to the low voltage in either a forward direction DIRf or a reverse direction DIRr in response to voltages of the gate lines GL.

In the forward direction mode, the main drive circuit 300 provides the gate drive circuit 500 with a gate driving signal including a vertical start signal STV, a plurality of clock signals CK1 and CK2, at least one OFF signals VSS1 and VSS2, a first power signal VDD1 and a second power signal VDD2. The first power signal VDD1 is set to a first level voltage VON (or ON voltage), and the second power signal VDD2 is set to a second level voltage (or a second OFF voltage) that is lower than the ON voltage VON. For example, the ON voltage VON can be about 22 V, and the second OFF voltage VSS2 can be about −10 V. The signal circuit 510 generates gate signals based on the first and second power signals VDD1 and VDD2 in the forward direction DIRf.

In the reverse direction mode, the main drive circuit 300 provides the gate drive circuit 100 with a gate driving signal including a vertical start signal STV, a plurality of clock signals CK1 and CK2, at least one OFF signals VSS1 and VSS2, a first power signal VDD1 and a second power signal VDD2. The first power signal VDD1 is set to the second OFF voltage VSS2, and the second power signal VDD2 is set to the ON voltage VON. The signal circuit 510 generates gate signals based on the first and second power signals VDD1 and VDD2 in the reverse direction DIRr.

Figure 2:
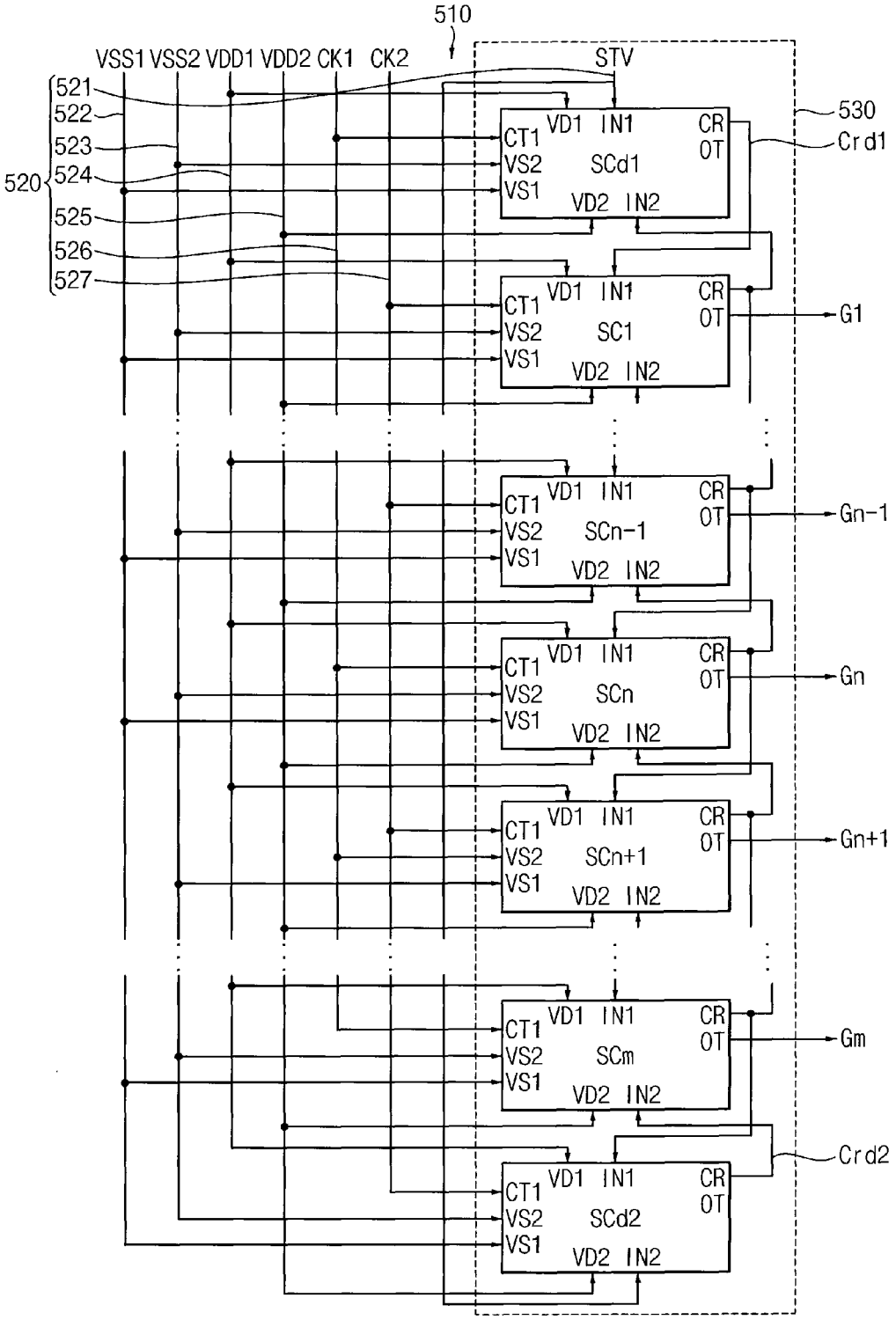
FIG. 2 is a block diagram of an exemplary signal circuit of the display apparatus of FIG. 1.

FIG. 2 is a block diagram of an exemplary signal circuit shown in FIG. 1.

Referring to FIGS. 1 and 2, the signal circuit 510 includes a wiring part 520 delivering a plurality of signals and a shift register 530 which is electrically coupled to the wiring part 520.

The wiring part 520 includes a vertical start wiring 521, a first OFF wiring 522, a second OFF wiring 523, a first power wiring 524, a second power wiring 525, a first clock wiring 526 and a second clock wiring 527.

The vertical start wiring 521 delivers a vertical start signal STV. The vertical start signal STV is a pulse signal having one frame period. A high level of the vertical start signal STV is typically the ON voltage VON, and a low level of the vertical start signal STV is typically the second OFF voltage VSS2.

The first OFF wiring 522 delivers a first OFF voltage VSS1. The first OFF voltage VSS1 is generally greater than the second OFF voltage VSS2 and smaller than the ON voltage VON. For example, the first OFF voltage VSS1 can be about −7 V.

The second OFF wiring 523 delivers the second OFF voltage VSS2.

The first power wiring 524 delivers a first power signal VDD1. The first power signal VDD1 is a DC voltage. In the forward direction mode, the first power signal VDD1 is set to the ON voltage VON. In the reverse direction mode, the first power signal VDD1 is set to the second OFF voltage VSS2.

The second power wiring 525 delivers a second power signal VDD2. The second power signal VDD2 is a DC voltage. In the forward direction mode, the second power signal VDD2 is set to the second OFF voltage VSS2. In the reverse direction mode, the second power signal VDD2 is set to the ON voltage VON.

The first clock wiring 526 delivers a first clock signal CK1. The first clock signal CK1 has a two horizontal period ("2H period"). The first clock signal CK1 can be a pulse signal which alternates between the ON voltage VON and a second OFF voltage VSS2. A duty ratio of the pulse signal can be about 50% or less than about 50%.

The second clock wiring 527 delivers a second clock signal CK2. The second clock signal CK2 is different from the first clock signal CK1. The second clock signal CK2 has a 2H period. The second clock signal CK2 can be a pulse signal which alternates between ON voltage VON and second OFF voltage VSS2. The second clock signal CK2 can be an inverted pulse signal having a phase opposite to the first clock signal CK1. A duty ratio of the pulse signal can be about 50% or less than about 50%.

The shift register 530 includes m driving stages SC1 to SCm, a first dummy driving stage SCd1 and a second dummy driving stage SCd2 that are coupled to each other sequentially.

The m driving stages SC1 to SCm are respectively coupled to m gate lines to output m gate signals to the gate lines. The first dummy driving stage SCd1 controls an operation of the first driving stage SC1, and the second dummy driving stage SCd2 controls an operation of the m-th driving stage SCm. The first and second dummy driving stages SCd1 and SCd2 are not electrically coupled to the gate lines.

Each of the driving stages includes a clock terminal CT, a first power terminal VD1, a second power terminal VD2, a first OFF terminal VS1, a second OFF terminal VS2, a first input terminal IN1, a second input terminal IN2, a carry terminal CR and an output terminal OT.

The clock terminal CT receives either the first clock signal CK1 or the second clock signal CK2. The clock terminals CT of odd-numbered driving stages SCd1, . . . , SCn−1, SCn+1 . . . , SCd2 receive the first clock signal CK1 and the clock terminals CT of even-numbered driving stages SC1, . . . , SCn, . . . , SCm receive the second clock signal CK2.

The first power terminal VD1 receives first power signal VDD1. The first power signal VDD1 is set to ON voltage VON in the forward direction mode and to second OFF voltage VSS2 in the reverse direction mode.

The second power terminal VD2 receives a second power signal VDD2. The second power signal VDD2 is set to second OFF voltage VSS2 in the forward direction mode and to ON voltage VON in the reverse direction mode.

The first OFF terminal VS1 receives a first OFF voltage VSS1 which is a low level of a gate signal.

The second OFF terminal VS2 receives second OFF voltage VSS2.

The first input terminal IN1 receives either a vertical start signal STV or a carry signal of a previous driving stage. The carry signal is synchronized with a gate signal output from the previous driving stage. For example, the first input terminal IN1 of a first dummy driving stage SCd1 is a first driving stage and therefore receives the vertical start signal STV. First input terminals IN1 of driving stages SC1, . . . , SCn−1, SCn, SCn+1, . . . , SCm and second dummy driving stage SCd2 receive carry signals from a previous stage. A previous driving stage of n-th driving stage SCn can be any one of driving stages SCd1, SC1, . . . , SCn−1.

The second input terminal IN2 receives a carry signal of either a following driving stage or the vertical start signal STV. The second input terminal IN2 of a second dummy driving stage SCd2 that is the last driving stage receives the vertical start signal STV. The second input terminals IN2 of the first dummy driving stages SCd1 and the m driving stages SC1, . . . , SCn−1, SCn, SCn+1, . . . , SCm receive a carry signal of a following driving stage. A following driving stage of an n-th driving stage SCn can be one of (n+1)-th to m-th driving stages SCn+1, . . . , SCm.

The carry terminal CR outputs a carry signal. The carry terminal CR is electrically coupled to the second input terminal IN2 of a previous driving stage and to the first input terminal IN1 of a following driving stage. A carry terminal CR of the first dummy driving stage SCd1 is electrically coupled to the first input terminal IN1 of a following driving stage, and a carry terminal CR of the second dummy driving stage SCd2 is electrically coupled to the second input terminal IN2 of a previous driving stage. A previous driving stage of n-th driving stage SCn is one of driving stages SCd1, SC1, . . . , SCn−1. A following driving stage of n-th driving stage SCn is one of driving stages SCn+1, . . . , SCm and SCd2.

Output terminal OT outputs a gate signal. Each output terminal of driving stages SC1, . . . , SCm is electrically coupled to a gate line. The output terminal OT of first dummy driving stage SCd1 and second dummy driving stage SCd2 are electrically floated.

Figure 3:
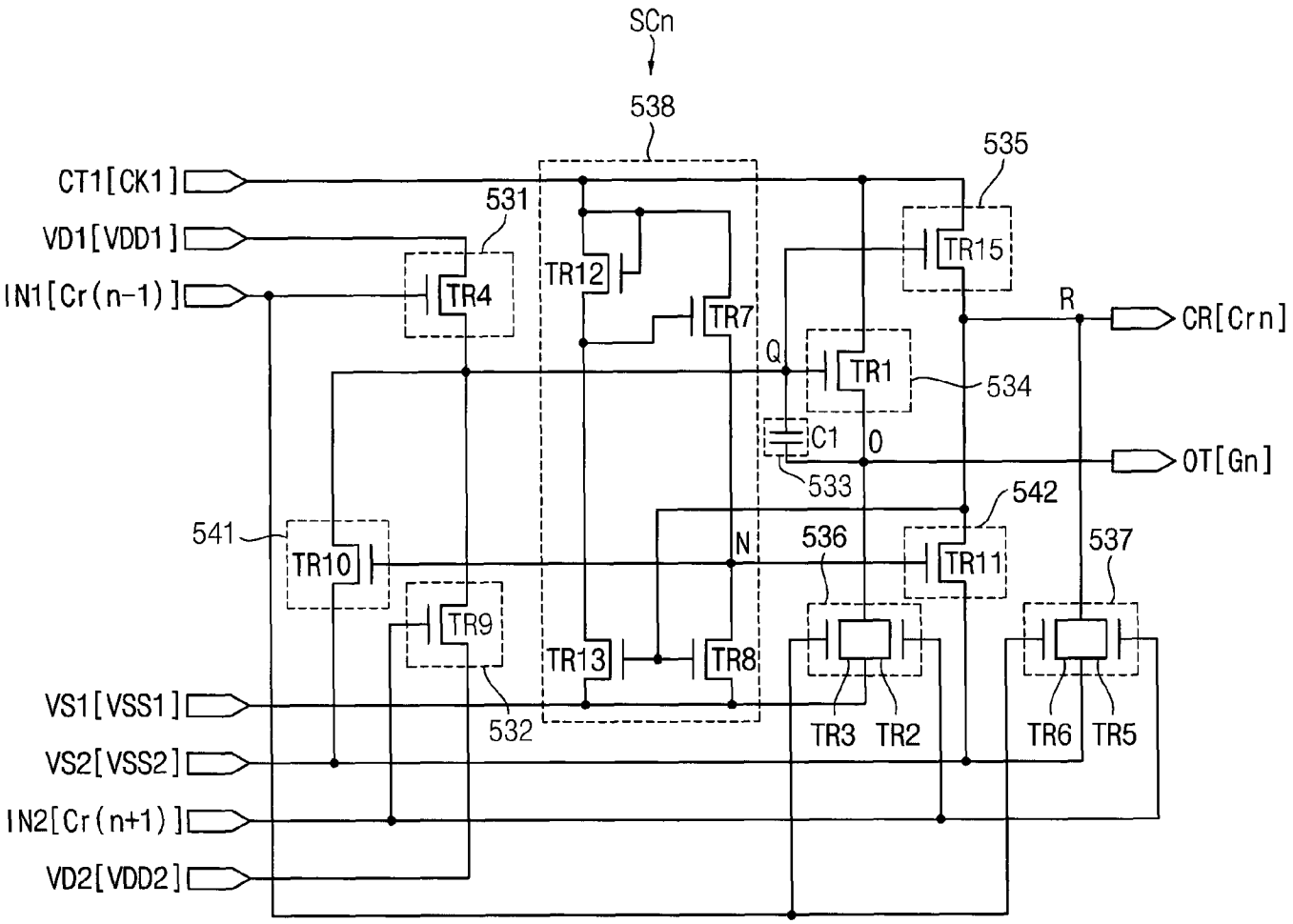
FIG. 3 is a circuit diagram of an exemplary n-th driving stage of the signal circuit of FIG. 2.

FIG. 3 is a circuit diagram of an exemplary driving stage SCn shown in FIG. 2.

Referring to FIGS. 2 and 3, driving stage SCn includes a first pull-up/down control part 531, a second pull-up/down control part 532, a charging part 533, a pull-up part 534, a carry part 535, a first pull-down part 536, a second pull-down part 537, an inverting part 538, a first maintain part 541 and a second maintain part 542.

The first pull-up/down part 531 includes a fourth transistor TR4. Transistor TR4 includes a control electrode coupled to input terminal IN to receive carry signal Cr(n−1), an input electrode coupled to first power terminal VD1 to receive first power signal VDD1, and an output electrode coupled to a first node Q. The first node Q corresponds to a control terminal of pull-up part 534. The first pull-up/down part 531 applies first power signal VDD1 to the first node Q in response to an ON voltage VON from carry signal Cr(n−1). The first pull-up/down part 531 applies ON voltage VON to first node Q in a forward direction mode, and applies second OFF voltage VSS2 to the first node Q in a reverse direction mode.

The second pull-up/down part 532 includes a ninth transistor TR9. Transistor TR9 includes a control electrode coupled to second input terminal IN2 to receive carry signal Cr(n+1), an input electrode coupled to second power terminal VS2 to receive second power signal VDD2, and an output electrode coupled to first node Q. The second pull-up/down part 532 applies the second power signal VDD2 to the first node Q in response to an ON voltage VON from carry signal Cr(n+1). The second pull-up/down part 532 applies second OFF voltage VSS2 to the first node Q in a forward direction mode and applies ON voltage VON to the first node Q in a reverse direction mode.

Charging part 533 includes charging capacitor C1. The charging capacitor C1 includes a first electrode coupled to a control electrode of the pull-up part 534 and a second electrode coupled to a second node O. The second node O corresponds to an output terminal of the pull-up part 534.

The pull-up part 534 includes a first transistor TR1. Transistor TR1 includes a control electrode coupled to first node Q, an input electrode coupled to clock terminal CT1 receiving a first clock signal CK1, and an output electrode coupled to a second node O. When ON voltage VON of first clock signal CK1 is applied to the clock terminal CT1 and the control electrode of the pull-up part is at a charging voltage of the charging part 533, the pull-up part 534 is bootstrapped. In this case, ON voltage VON applied to the first node Q is boosted. When a signal of the first node Q is boosted, the pull-up part 534 outputs an ON voltage VON of the first clock signal CK1 as an n-th gate signal Gn.

Carry part 535 includes a fifteenth transistor TR15. Transistor TR15 includes a control electrode coupled to first node Q, an input electrode coupled to clock terminal CT, and an output electrode coupled to a fourth node R. The fourth node R corresponds to an output terminal of carry part 535. When a signal of the first node Q is boosted, the carry part 535 outputs ON voltage VON of the first clock signal CK1 as n-th carry signal CRn, which is received by the clock terminal CT.

First pull-down part 536 includes a second transistor TR2 and a third transistor TR3. The second transistor TR2 includes a control electrode coupled to second input terminal IN2, an input electrode coupled to second node O, and an output electrode coupled to a first OFF terminal VS1 receiving first OFF voltage VSS1. The third transistor TR3 includes a control electrode coupled to the first input terminal IN1, an input electrode coupled to second node O, and an output electrode coupled to first OFF terminal VS1. The first pull-down part 536 pulls down second node O to the first OFF voltage VSS1 in response to a carry signal Cr(n−1) from a previous driving stage and carry signal Cr(n+1) from a following driving stage. The first pull-down part 536 thus pulls down the n-th gate signal Gn from ON voltage VON to first OFF voltage VSS1.

The second pull-down part 537 includes a fifth transistor TR5 and a sixth transistor TR6. Fifth transistor TR5 includes a control electrode coupled to the second input terminal N2, an input electrode coupled to fourth node R and an output electrode coupled to a second OFF terminal VS2 receiving second OFF voltage VSS2. Sixth transistor TR6 includes a control electrode coupled to the first input terminal IN1, an input electrode coupled to the fourth node R and an output electrode coupled to the second OFF terminal VS2. The second pull-down part 537 pulls down fourth node R to second OFF voltage VSS2 in response to carry signal Cr(n−1) from a previous driving stage and carry signal Cr(n+1) from a following driving stage. The second pull-down part 537 thus pulls down the n-th carry signal CRn to second OFF voltage VSS2.

The inverting part 538 includes a twelfth transistor TR12, a seventh transistor TR7, a thirteenth transistor TR13 and an eighth transistor TR8. The twelfth transistor TR12 includes a control electrode and an input electrode that are coupled to the clock terminal CT and an output electrode coupled to an input electrode of the thirteenth transistor TR13 and a control electrode of seventh transistor TR7. An input electrode of the seventh transistor TR7 is coupled to the clock terminal CT, and an output electrode of seventh transistor TR7 is coupled to an input electrode of eighth transistor TR8 as well as to a third node N. The third node N corresponds to an output terminal of inverting part 538. The inverting part 538 controls voltage applied to the third node N. The inverting part 538 applies a signal to the third node N that is synchronized with first clock signal CK1 received at clock terminal CT. When ON voltage VON is applied to the fourth node R, the eighth and thirteenth transistors TR8 and TR13 discharge the voltage of third node N to first OFF voltage VSS1.

The first maintain part 541 includes a tenth transistor TR10. Transistor TR10 includes a control electrode coupled to the third node N, an input electrode coupled to first node Q and an output electrode coupled to the second OFF terminal VS2. The first maintain part 541 discharges the first node Q to second OFF voltage VSS2 in response to ON voltage VON at the third node N.

The second maintain part 542 includes an eleventh transistor TR11. The eleventh transistor TR11 includes a control electrode coupled to the third node N, an input electrode coupled to the fourth node R and an output electrode coupled to the second OFF terminal VS2. The second maintain part 542 discharges the fourth node R to the second OFF voltage VSS2 in response to an ON voltage VON at the third node N.

Figure 4:
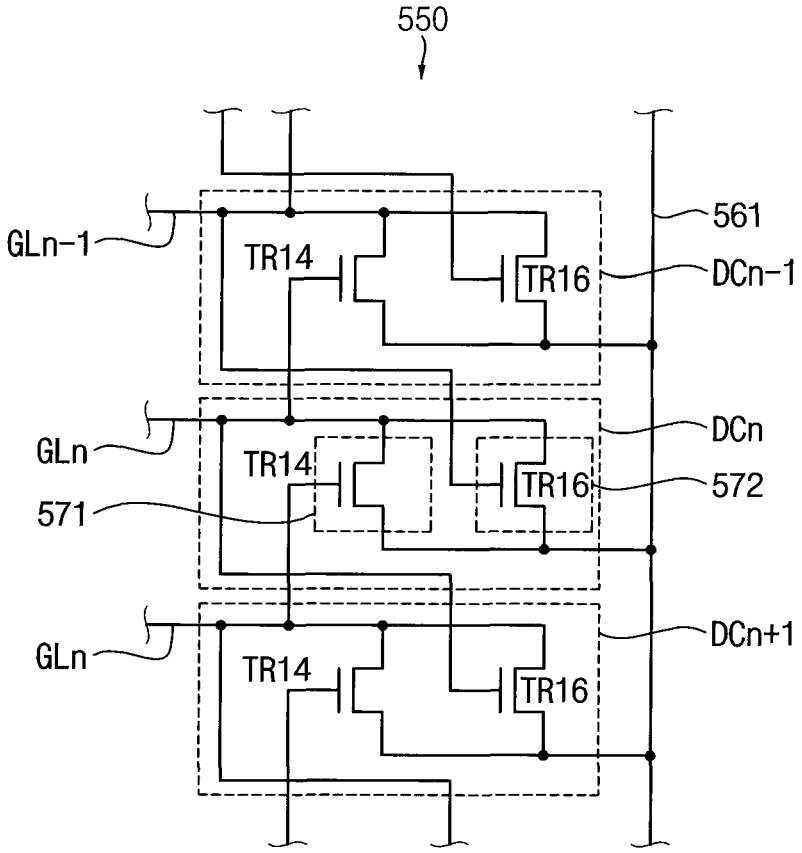
FIG. 4 is a block diagram of an exemplary discharging circuit of the display apparatus of FIG. 1.

FIG. 4 is a block diagram of an exemplary discharging circuit shown in FIG. 1.

Referring to FIGS. 2 and 4, the discharging circuit 550 includes m discharging stages that are coupled to a third OFF wiring 561 and to the m gate lines.

The third OFF wiring 561 is set to first OFF voltage VSS1.

Each of the discharging stages is coupled to a corresponding gate line to discharge a voltage applied to the corresponding gate line to first off voltage VSS1 in response to ON voltage VON at either a previous gate line or a following gate line. For example, discharging stage DCn includes a first discharging part 571 and a second discharging part 572. The first discharging part 571 includes a fourteenth transistor TR14, and the second discharging part 572 includes a sixteenth transistor TR16. The fourteenth transistor TR14 includes a control electrode coupled to an (n+1)-th gate line GLn+1, an input electrode coupled to the third OFF wiring and an output electrode coupled to the n-th gate line GLn. The sixteenth transistor TR16 includes a control electrode coupled to an (n−1)-th gate line GLn−1, an input electrode coupled to the third OFF wiring 561 and an output electrode coupled to the n-th gate line GLn.

When (n+1)-th gate line GLn+1 is at ON voltage VON, the fourteenth transistor TR14 discharges the n-th gate line GLn from ON voltage VON to first OFF voltage VSS1. When (n−1)-th gate line GLn−1 is at ON voltage VON, the sixteenth transistor TR16 discharges the n-th gate line GLn from ON voltage VON to first OFF voltage VSS1.

In the forward direction mode, the ON voltage VON is sequentially applied to the (n−1)-th, n-th and (n+1)-th gate lines GLn−1, GLn and GLn+1 at a delay of one horizontal period (1H). The fourteenth transistor TR14 of GLn discharges ON voltage VON of the n-th gate line GLn to first OFF voltage VSS1 in response to the ON voltage VON of the (n+1)-th gate line GLn+1. Therefore, the ON voltage VON of the n-th gate line GLn falls into the first OFF voltage VSS1. Since the first OFF voltage VSS1 is applied to the n-th gate line GLn while ON voltage VON is applied to the (n−1)-th gate line GLn−1, the sixteenth transistor TR16 is turned on. However, a function of pulling a voltage applied to the n-th gate line GLn is not performed.

In the reverse direction mode, the ON voltage VON is sequentially applied to the (n+1)-th, n-th and (n−1)-th gate lines GLn+1, GLn and GLn−1 at a delay of one horizontal period (1H). The sixteenth transistor TR16 of GLn discharges ON voltage VON of the n-th gate line GLn to first off voltage VSS1 in response to an ON voltage VON of the (n−1)-th gate line GLn−1. Therefore, the ON voltage VON of the n-th gate line GLn falls into the first OFF voltage VSS1. Since the first OFF voltage VSS1 is applied to the n-th gate line GLn during while ON voltage VON is applied to the (n+1)-th gate line GLn+1, the fourteenth transistor TR14 is turned on. However, a function of pulling a voltage applied to the n-th gate line GLn is not performed.

Accordingly, the discharging circuit 550 discharges ON voltage VON corresponding to the gate lines into the first OFF voltage VSS1 in both the forward direction mode and the reverse direction mode.

Figure 5:
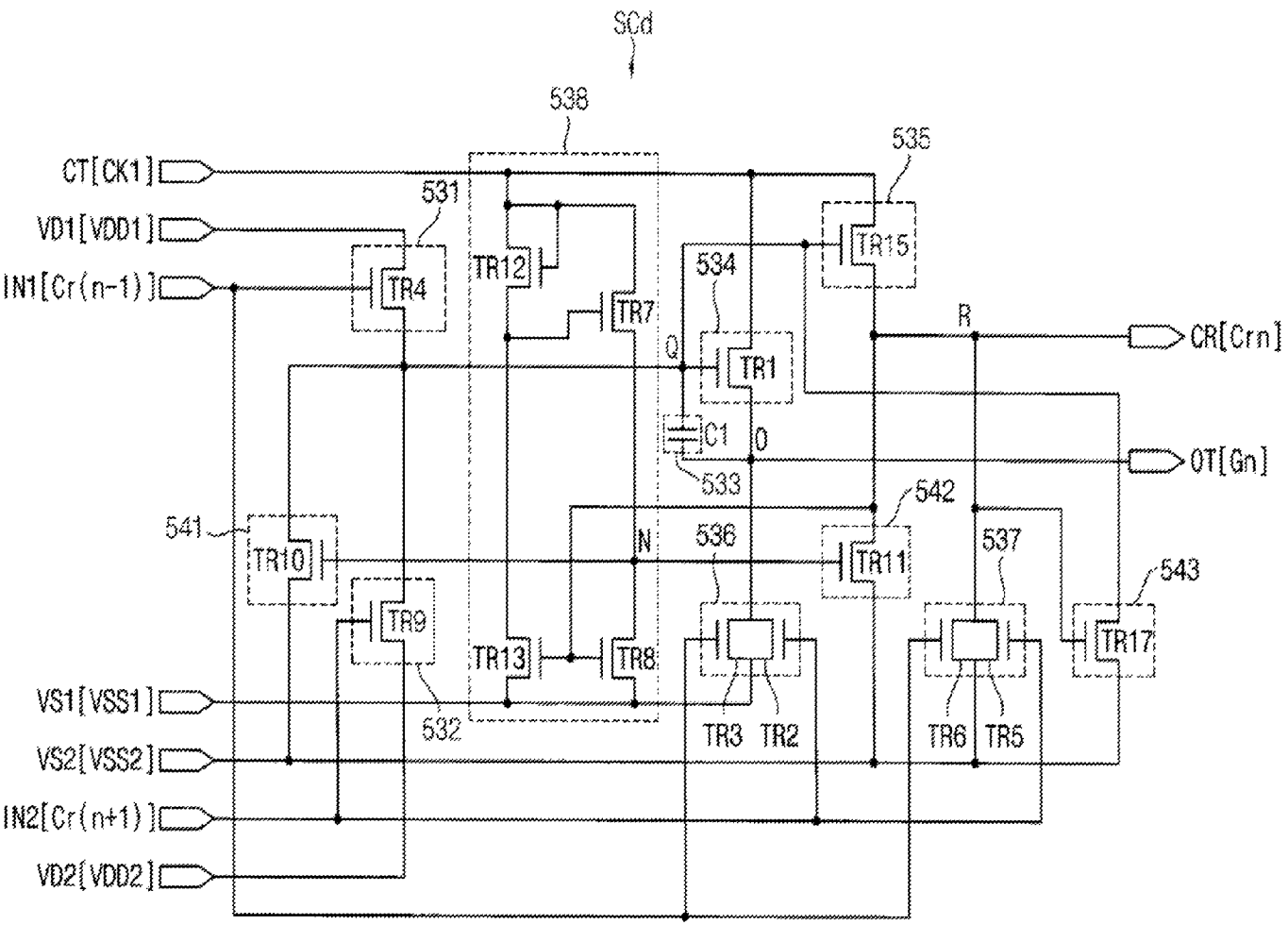
FIG. 5 is a circuit diagram of an exemplary dummy driving stage shown in FIG. 2.

FIG. 5 is a circuit diagram of an exemplary dummy driving stage shown in FIG. 2.

Referring to FIGS. 2, 3 and 5, the exemplary dummy driving stage SCd is a circuit diagram for the first dummy driving stage SCd1 and the second dummy driving stage SCd2 shown in FIG. 2. Compared to the n-th driving stage SCn of FIG. 3, dummy driving stage SCd further includes a self reset part 543.

Referring to FIGS. 3 and 5, the self reset part 543 includes a seventeenth transistor TR17. Seventeenth transistor TR17 includes a control electrode coupled to a fourth node R, an input electrode coupled to the first node Q, and an output electrode coupled to the second OFF terminal VS2. The seventeenth transistor TR17 discharges a voltage of first node Q to second OFF voltage VSS2 when ON voltage VON is applied at fourth node R. In this manner, the dummy driving stage SCd is reset.

Figure 6:
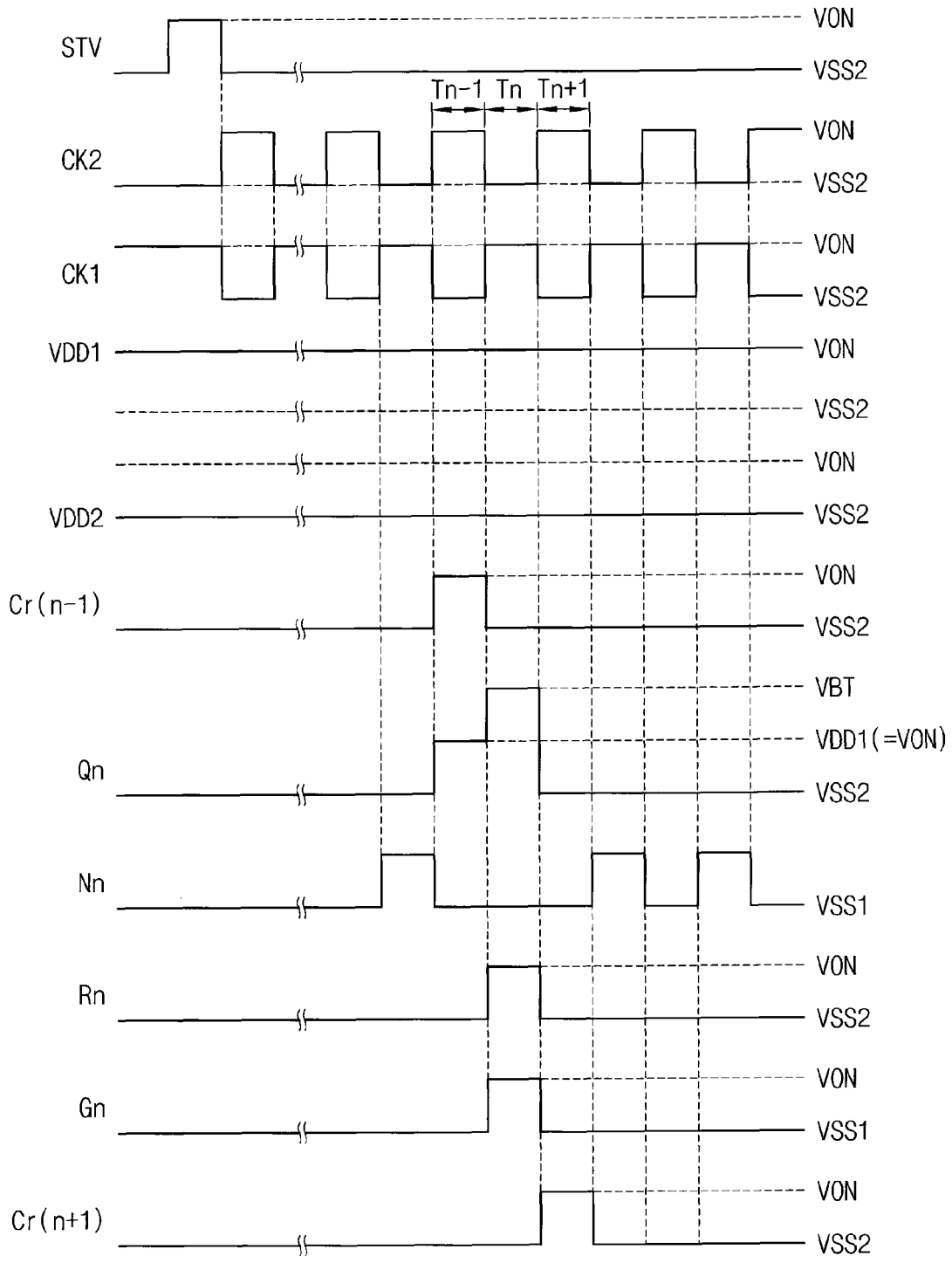
FIG. 6 is a waveform diagram showing input and output signals for a forward direction mode of a shift register of the exemplary signal circuit of FIG. 2.

FIG. 6 is a waveform diagram showing input and output signals for a forward direction mode of the exemplary shift register shown in FIG. 2.

Referring to FIGS. 3 and 6, the shift register 530 receives a vertical start signal STV, a first power signal VDD1, a second power signal VDD2, a first OFF voltage VSS1, a second OFF voltage VSS2, a first clock signal CK1 and a second clock signal CK2. In the forward direction mode, the first power signal VDD1 is set of ON voltage VON and the second power signal VDD2 is set to second OFF voltage VSS2.

In a K-th frame interval, a vertical start signal STV at ON voltage VON is applied to a first dummy driving stage SCd1. The first dummy driving stage SCd1 generates a first dummy carry signal Crd1 which is synchronized with first clock signal CK1 in response to the vertical start signal STV. A pulse of the vertical start signal STV can be designed not to overlap with a pulse of the first clock signal CK1 as shown in FIG. 6. That is, the VON portion of the STV signal may be not overlapped with the pulse of the first clock signal CK1. Alternatively, the pulse of the vertical start signal STV can be designed to partially overlap with the pulse of the first clock signal CK1.

When the first dummy gate signal Gd1 is applied to a first input terminal IN1 of first driving stage SC1, the shift register 530 is driven in a forward direction DIRf so that gate signals are sequentially generated in the order from G1 to Gm. In response to m-th gate signal Gm, second dummy driving stage SCd2 generates a second dummy carry signal Crd2 synchronized with the second clock signal CK2.

In an (K+1)-th frame interval, a vertical start signal STV at ON voltage VON is applied to second input terminal IN2 of the second dummy driving stage SCd2, and the second dummy driving stage SCd2 pulls down the second carry signal Crd2 from ON voltage VON to second OFF voltage VSS2.

Operation of an exemplary n-th driving stage SCn in the forward direction driving mode is now explained. In FIG. 6, for driving stage SCn, a signal at first node Q is represented by a reference numeral "Qn", a signal at third node N is represented by a reference numeral "Nn", and a signal at fourth node R is represented by a reference numeral "Rn".

At driving stage SCn, ON voltage VON of an (n−1)-th carry signal Cr(n−1) is received by a control electrode of a fourth transistor TR4 during an (n−1)-th interval Tn−1 of a K-th frame. Fourth transistor TR4 is turned on and first power signal VDD1 (ON voltage VON) is applied to the first node Q. Charging part 533 therefore charges to VON. Second OFF voltage VSS2 (synchronized with first clock signal CK1) is applied to third node N. ON voltage VON of the (n−1)-th carry signal Cr(n−1) is received by the control electrode of third transistor TR3 and by the control electrode of sixth transistor TR6. The third transistor TR3 is turned on to discharge the second node O to the first OFF voltage VSS1. The sixth transistor TR6 is turned on to discharge voltage at the fourth node R to the second OFF voltage VSS2. Thus, during (n−1)-th interval Tn1, the n-th gate signal Gn (corresponding to second node O) maintains first OFF voltage VSS1, and signal Rn of the fourth node R maintains second OFF voltage VSS2.

During n-th time interval Tn, input electrode of first transistor TR1 receives ON voltage VON from the first clock CK1 and the first transistor TR1 is bootstrapped. The control electrode of TR1 (and therefore first node Q) is boosted to a boosting voltage VBT. Therefore, the first node Q is at ON voltage VON in the (n−1)-th interval Tn−1 and is at boosting voltage VBT in n-th interval Tn. During the n-th interval Tn, with first node Q at boosting voltage VBT, first transistor TR1 outputs the ON voltage VON of the first clock signal CK1 to gate signal Gn. During the same interval Tn, fifteenth transistor TR15 outputs the ON voltage VON of the first clock signal CK1 to carry signal Crn. Carry signal Cm thus outputs ON voltage VON. Eighth and thirteenth transistors TR8 and TR13 are turned on in response to the ON voltage VON at carry signal Crn, thereby discharging third node N to first OFF voltage VSS1.

During an (n+1)-th interval Tn+1, an (n+1)-th carry signal Cr(n+1) (at ON voltage VON) is received at control electrode of ninth transistor TR9. In response to carry signal Cr(n+1) at ON voltage VON, ninth transistor TR9 discharges first node Q to second power signal VDD2 (second OFF voltage VSS2). Additionally, ON voltage VON of carry signal Cr(n+1) is received at the control electrode of second transistor TR2 and the control electrode of fifth transistor TR5. The second transistor TR2 is turned on to discharge second node O to first OFF voltage VSS1. The fifth transistor TR5 is turned on to discharge fourth node R to a second OFF voltage VSS2. Thus, during an (n+1)-th interval Tn+1, gate signal Gn (corresponding to second node O) maintains first OFF voltage VSS1, and signal Rn of the fourth node R maintains second OFF voltage VSS2.

After the (n+1)-th interval Tn+1, the tenth and eleventh transistors TR10 and TR11 maintain the first and fourth nodes Q and R at second OFF voltage VSS2 as determined by the voltage of third node N. The tenth transistor TR10 maintains the first node Q at second OFF voltage VSS2 in response to the ON voltage VON at third node N synchronizing with the first clock signal CK1. The eleventh transistor TR11 maintains fourth node R at second OFF voltage VSS2 in response to the ON voltage VON at the third node N.

Using the driving method described above with respect to the n-th driving stage in the forward direction mode, driving stages SC1, . . . , SCm are sequentially driven in a forward direction DIRf to output gate signals G1, G2, . . . , Gm.

Figure 7:
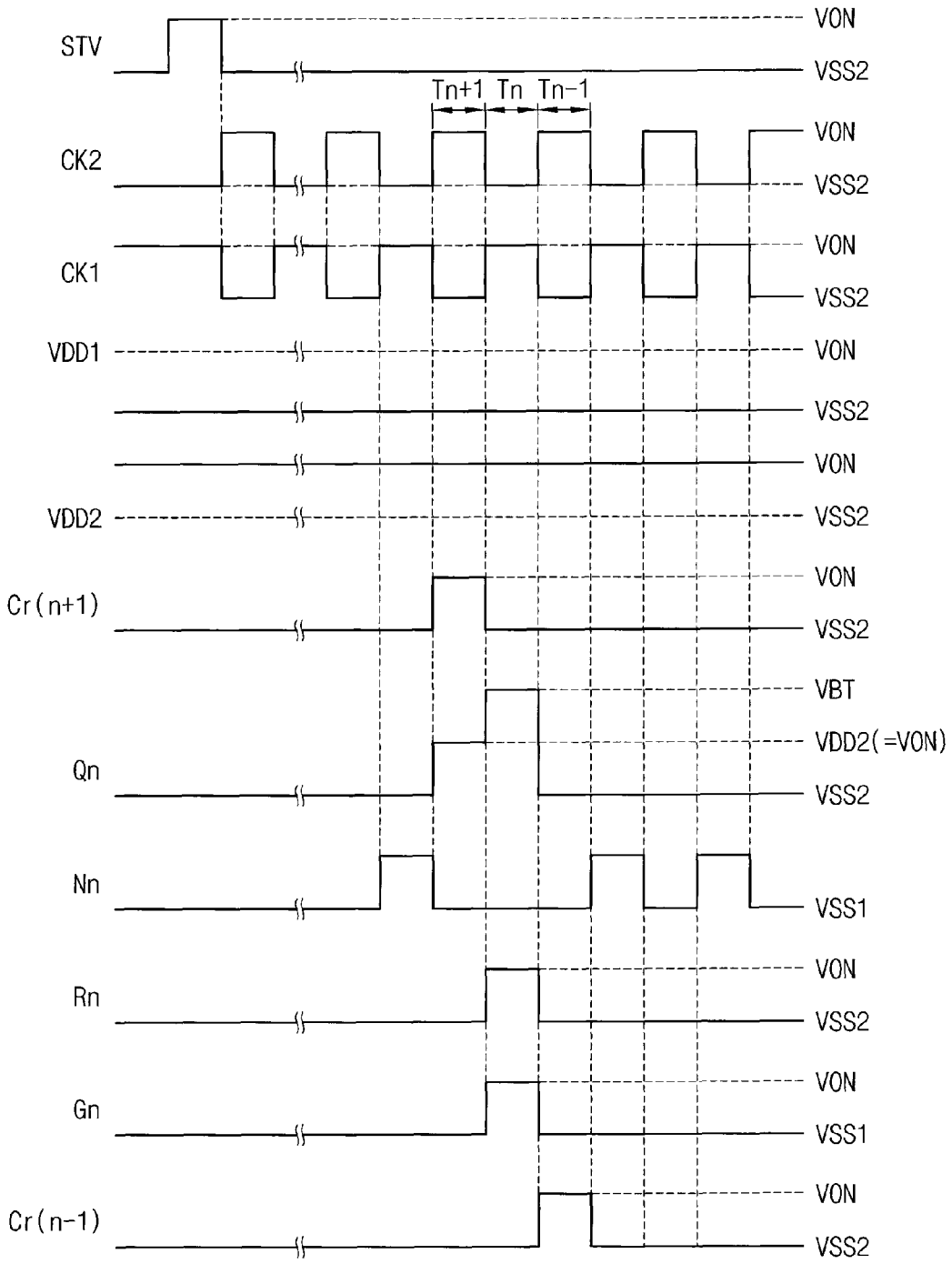
FIG. 7 is a waveform diagram showing input and output signals for a reverse direction mode of a shift register of the exemplary signal circuit of FIG. 2.

FIG. 7 is a waveform diagram showing input and output signals for a reverse direction mode of an exemplary shift register shown in FIG. 2.

Referring to FIGS. 3 and 7, the shift register 530 receives a vertical start signal STV, a first power signal VDD1, a second power signal VDD2, a first OFF voltage VSS1, a second OFF voltage VSS2, a first clock signal CK1 and a second clock signal CK2. In the reverse direction mode, the first power signal VDD1 is set to second OFF voltage VSS2, and the second power signal VDD2 is set to ON voltage VON.

In a K-th frame interval, a vertical start signal STV at ON voltage VON is applied to a second dummy driving stage SCd2. In response to the vertical start signal STV, the second dummy driving stage SCd2 generates a second dummy carry signal Crd2 that is synchronized with a second clock signal CK2. A pulse of the vertical start signal STV may be designed not to overlap with a pulse of the second clock signal CK2 as shown in FIG. 7. Alternatively, the pulse of the vertical start signal STV may be designed to partially overlap with the pulse of the second clock signal CK2.

When the second dummy carry signal Crd2 is applied to a first input terminal IN2 of the m-th driving stage SCm, the shift register 530 is driven in a reverse direction DIRr so that m-th to first gate signals Gm, . . . , G1 are sequentially generated. A first dummy driving stage SCd1 generates a first dummy carry signal Crd1 synchronized with the first clock signal CK1 in response to a first carry signal CR1 of the first driving stage SC1.

In an (K+1)-th frame interval, when a vertical start signal STV at ON voltage VON is applied to a first input terminal IN1 of the first dummy driving stage SCd1, the first dummy driving stage SCd1 pulls down the first carry signal Crd1 of the ON voltage VON into a second OFF voltage VSS2.

Operation of an exemplary n-th driving stage SCn in a reverse direction driving is now explained. In FIG. 7, for driving stage SCn, a signal at first node Q is represented by a reference numeral "Qn", a signal at third node N is represented by a reference numeral "Nn", and a signal at fourth node R is represented by a reference numeral "Rn".

At driving stage SCn, ON voltage VON of an (n+1)-th carry signal Cr(n+1) is received by a control electrode of ninth transistor TR9 during an (n+1)-th interval Tn+1 of an K-th frame. Ninth transistor TR9 is turned on and second power signal VDD2 (ON voltage VON) is applied to the first node Q. Charging part 533 therefore charges to VON. Second OFF voltage VSS2 synchronized with the first clock signal CK1 is applied to the third node N. The ON voltage VON of the (n+1)-th carry signal Cr(n+1) is received by the control electrode of second transistor TR2 and by the control electrode of fifth transistor TR5. The second transistor TR2 is turned on to discharge the second node O to the first OFF voltage VSS1. The fifth transistor TR5 is turned on to discharge a voltage of the fourth node R to the second OFF voltage VSS2. Thus, during an (n+1)-th interval Tn+1, the n-th gate signal Gn (corresponding to second node O) maintains first OFF voltage VSS1, and signal Rn of the fourth node R maintains second OFF voltage VSS2.

During the (n+1)-th time interval Tn+1, input electrode of first transistor TR1 receives ON voltage VON from the first clock CK1 and the first transistor TR1 is bootstrapped. The control electrode of TR1 and therefore first node Q is boosted to a boosting voltage VBT. Therefore, the first node Q is at ON voltage VON in an (n+1)-th interval Tn+1 and is at boosting voltage VBT in n-th interval Tn. During the n-th interval Tn, with first node Q at boosting voltage VBT, first transistor TR1 outputs the ON voltage VON of the first clock signal CK1 to gate signal Gn. During the same interval Tn, the fifteenth transistor TR15 outputs the ON voltage VON of the first clock signal CK1 to carry signal Crn. Carry signal Crn thus outputs ON voltage VON. Eighth and thirteenth transistors TR8 and TR13 are turned on in response to the ON voltage VON at carry signal Crn, so that the third node N is discharged into a first OFF voltage VSS1.

During an (n−1)-th interval Tn−1, an (n−1)-th carry signal Cr(n−1) (at ON voltage VON) is received at control electrode of fourth transistor TR4. In response to carry signal Cr(n−1) at ON voltage VON, the fourth transistor TR4 discharges first node Q to first power signal VDD1 (second OFF voltage VSS2). Additionally, ON voltage VON of carry signal Cr(n−1) is received at the control electrode of third transistor TR3 and the control electrode of sixth transistor TR6. The third transistor TR3 is turned on to discharge the second node O to first OFF voltage VSS1. The sixth transistor TR6 is turned on to discharge fourth node R to a second OFF voltage VSS2. Thus, during an (n−1)-th interval Tn−1, gate signal Gn (corresponding to second node O) maintains the first OFF voltage VSS1, and signal Rn of the fourth node R maintains second OFF voltage VSS2.

After an (n−1)-th interval Tn−1, the tenth and eleventh transistors TR10 and TR11 maintain the first and fourth nodes Q and R at second OFF voltage VSS2 as determined by the voltage at third node N. Tenth transistor TR10 maintains a voltage of the first node Q at second OFF voltage VSS2 in response to the ON voltage VON of the third node N synchronizing with the first clock signal CK1. The eleventh transistor TR11 maintains the fourth node R at second OFF voltage VSS2 in response to the ON voltage VON at the third node N.

Using the driving method described above with respect to the n-th driving stage in the reverse direction mode, driving stages SCm, . . . , SC1 are sequentially driven in a reverse direction DIRr to output gate signals Gm, Gm−1, . . . , G1.

Figure 8:
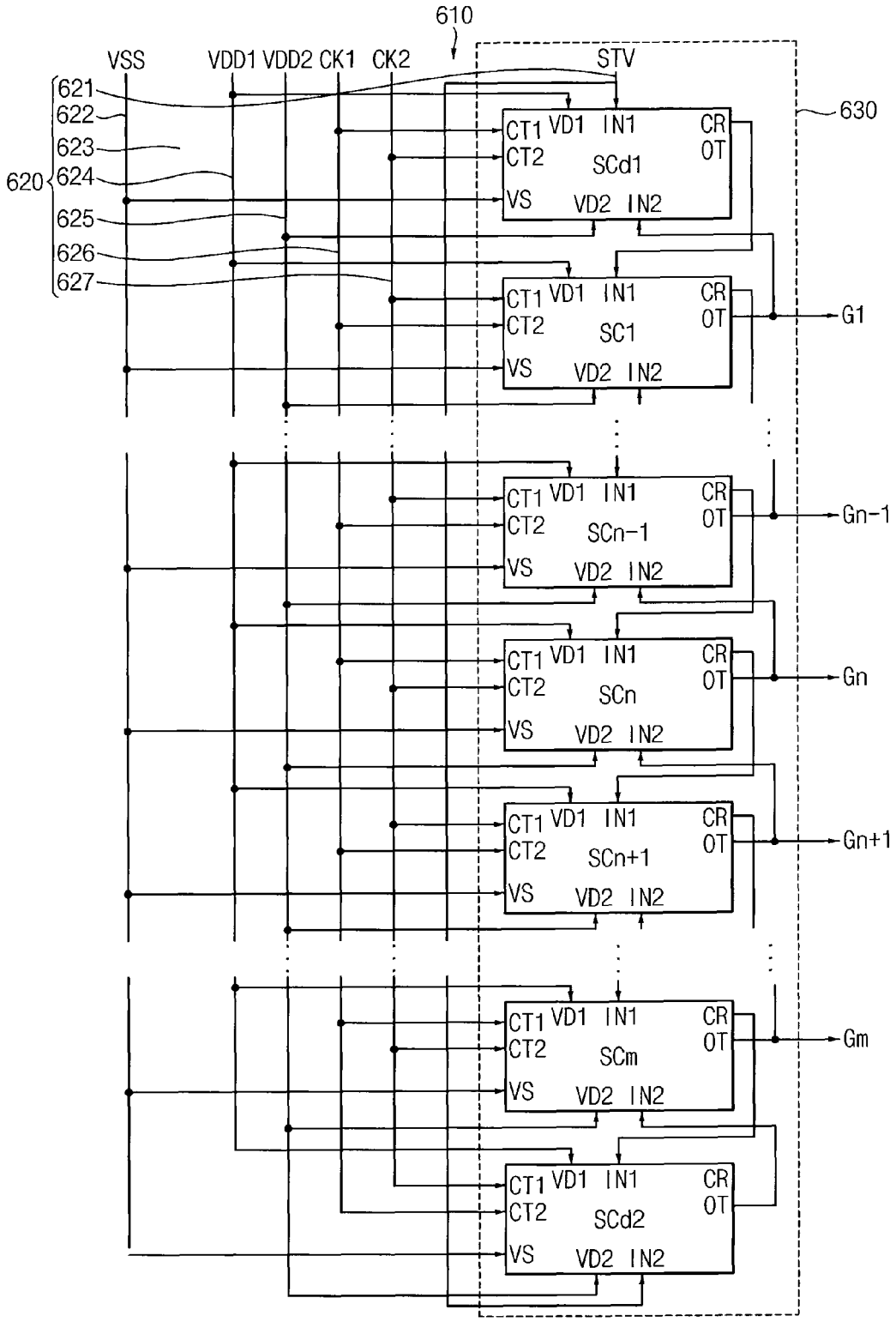
FIG. 8 is a block diagram of another exemplary signal circuit according to the present invention.

FIG. 8 is a block diagram of another exemplary signal circuit according to the present invention.

Referring to FIG. 8, the signal circuit 610 includes a wiring part 620 delivering a plurality of signals and a shift register 630 which is electrically coupled to the wiring part 620.

The wiring part 620 includes a vertical start wiring 621, an OFF wiring 622, a first power wiring 624, a second power wiring 625, a first clock wiring 626 and a second clock wiring 627.

The vertical start wring 621 delivers a vertical start signal STV. The vertical start signal STV is a pulse signal having one frame period. A high level of the vertical start signal STV can be ON voltage VON, and a low level of the vertical start signal STV can be OFF voltage VSS.

The OFF wiring 622 delivers the OFF voltage VSS. The OFF voltage VSS can be from about −5 V to about −15 V.

The first power wiring 624 delivers first power signal VDD1. In the forward direction mode, the first power signal VDD1 is set to ON voltage VON. In the reverse direction mode, the first power signal VDD1 is set to OFF voltage VSS.

The second power wiring 625 delivers second power signal VDD2. In the forward direction mode, the second power signal VDD2 is set to OFF voltage VSS. In the reverse direction mode, the second power signal VDD2 is set to ON voltage VON.

The first clock wiring 626 delivers a first clock signal CK1. The first clock signal CK1 has a 2H period. The first clock signal CK1 may be a pulse signal which alternates between ON voltage VON and OFF voltage VSS. A duty ratio of the pulse signal can be about 50% or less than about 50%.

The second clock wiring 627 delivers a second clock signal CK2. The second clock signal CK2 is different from the first clock signal CK1. The second clock signal CK2 has a 2H period. The second clock signal CK2 can be a pulse signal which alternates between ON voltage VON and OFF voltage VSS. The second clock signal CK2 can be an inverted pulse signal having a phase opposite to the first clock signal CK1. A duty ratio of the pulse signal can be about 50% or less than about 50%.

The shift register 630 includes m driving stages SC1 to SCm that are coupled to each other sequentially, a first dummy driving stage SCd1 and a second dummy driving stage SCd2.

The m driving stages SC1-SCm are respectively coupled to m gate lines to output m gate signals to the gate lines. The first dummy driving stage SCd1 controls an operation of the first driving stage SC1, and the second dummy driving stage SCd2 controls an operation of the m-th driving stage SCm. The first and second dummy driving stages SCd1 and SCd2 are not electrically coupled to the gate lines.

Each driving stage includes a first clock terminal CT1, a second clock terminal CT2, a first power terminal VD1, a second power terminal VD2, an OFF terminal VS, a first input terminal IN1, a second input terminal IN2, a carry terminal CR and an output terminal OT.

The first clock terminal CT1 receives either the first clock signal CK1 or the second clock signal CK2. The first clock terminal CT1 of the odd-numbered driving stages SCd1, . . . , SCn−1, SCn+1 . . . , SCd2 receive the first clock signal CK1, and the first clock terminal CT1 of even-numbered driving stages SC1, . . . , SCn, . . . , SCm receive the second clock signal CK2.

The second clock terminal CT2 receives either the first clock CK1 or the second clock signal CK2. The second clock terminals CT2 of odd-numbered driving stages SCd1, . . . , SCn−1, SCn+1 . . . , SCd2 receive the second clock signal CK2, and the second clock terminals CT2 of even-numbered driving stages SC1, . . . , SCn, . . . , SCm receive the first clock signal CK1.

The first power terminal VD1 receives first power signal VDD1. The first power signal VDD1 is set to ON voltage VON in the forward direction mode and to OFF voltage VSS in the reverse direction mode.

The second power terminal VD2 receives second power signal VDD2. The second power signal VDD2 is set to OFF voltage VSS in the forward direction mode and to ON voltage VON in the reverse direction mode.

The OFF terminal VS receives the OFF voltage VSS.

The first input terminal IN1 receives either the vertical start signal STV or a carry signal of a previous driving stage. The carry signal may be synchronized with a gate signal output from a previous driving stage. The previous driving stage of an n-th driving stage SCn is one of driving stages SCd1, SC1, . . . , SCn−1.

The second input terminal IN2 receives either a gate signal of a following driving stage or the vertical start signal STV. A following driving stage of an n-th driving stage SCn is one of (n+1)-th to m-th driving stages SCn+1, . . . , SCm. The second input terminal IN2 of a second dummy driving stage SCd2 receives the vertical start signal STV.

The carry terminal CR outputs a carry signal synchronized with a gate signal.

The output terminal OT outputs a gate signal. Each output terminal of driving stages SC1, . . . , SCm is electrically coupled to a gate line. The output terminal OT is also electrically coupled to a second input terminal IN2 of a previous driving stage.

Figure 9:
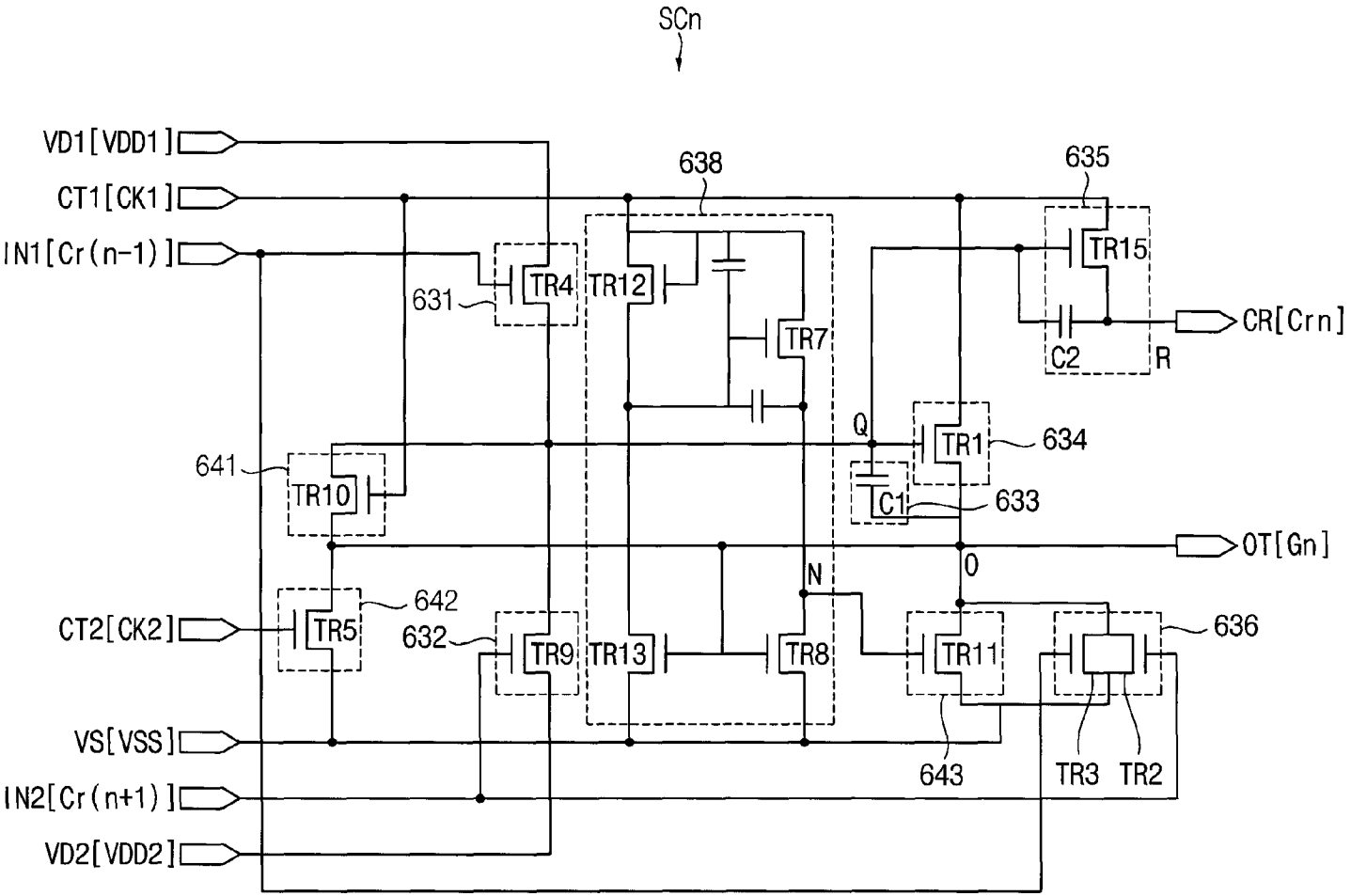
FIG. 9 is a circuit diagram of an exemplary n-th driving stage shown in FIG. 8.

FIG. 9 is a circuit diagram of an exemplary n-th driving stage shown in FIG. 8.

Referring to FIG. 9, driving stage SCn includes a first pull-up/down control part 631, a second pull-up/down control part 632, a charging part 633, a pull-up part 634, a carry part 635, a pull-down part 636, an inverting part 638, a first maintain part 641, a second maintain part 642 and a third maintain part 643.

The first pull-up/down control part 631 includes a fourth transistor TR4. The fourth transistor TR4 includes a control electrode coupled to first input terminal IN receiving an (n−1)-th carry signal Cr(n−1), an input electrode coupled to first power terminal VD1 receiving first power signal VDD1, and an output electrode coupled to a first node Q. When carry signal Cr(n−1) is set to ON voltage VON, the first pull-up/down control part 631 applies first power signal VDD1 to the first node Q. The first pull-up/down control part 631 therefore applies ON voltage VON to the first node Q in the forward direction mode and OFF voltage VSS to the first node Q in the reverse direction mode.

The second pull-up/down control part 632 includes a ninth transistor TR9. The ninth transistor TR9 includes a control electrode coupled to a second input terminal IN2 receiving an (n+1)-th gate signal G(n+1), an input electrode coupled to a second power terminal VD2 receiving second power signal VDD2, and an output electrode coupled to the first node Q. When gate signal G(n+1) is set to ON voltage VON, the second pull-up/down control part 632 applies second power signal VDD2 to the first node Q. The second pull-up/down control part 632 therefore applies second OFF voltage VSS2 to the first node Q in the forward direction mode, and applies ON voltage VON to the first node Q in the reverse direction mode.

The charging part 633 includes a charging capacitor C1. The charging capacitor C1 includes a first electrode coupled to a control electrode of the pull-up part 634 and a second electrode coupled to a second node O.

The pull-up part 634 includes a first transistor TR1. The first transistor TR1 includes a control electrode coupled to the first node Q, an input electrode coupled to a first clock terminal CT1, and an output electrode coupled to the second node O. When charging voltage VC of the charging part 633 is applied to the control electrode of the pull-up part 634 and the first clock signal CK1 receives an ON voltage VON, the pull-up part 634 is boosted. In this case, the ON voltage ON applied to the first node Q is boosted. When a signal of the first node Q is boosted, the pull-up part 634 outputs ON voltage VON of the first clock signal CK1 to n-th gate signal Gn.

The carry part 635 includes a fifteenth transistor TR15. The fifteenth transistor TR15 includes a control electrode coupled to the first node Q, an input electrode coupled to the clock terminal CT1, and an output electrode coupled to a fourth node R. The carry part 635 outputs ON voltage VON at first clock signal CK1 as an n-th carry signal VON when the first node Q is at ON voltage VON. The carry part 635 can further include a capacitor C2 coupled to the control electrode of the fifteenth transistor TR15 and the output electrode of the fifteenth transistor TR15.

The pull-down part 636 includes a second transistor TR2 and a third transistor TR3. The second transistor TR2 includes a control electrode coupled to the second input terminal IN2, an input electrode coupled to second node O, and an output electrode coupled to an OFF terminal VS. The third transistor TR3 includes a control electrode coupled to first input terminal IN1, an input electrode coupled to second node O and an output electrode coupled to OFF terminal VS. The pull-down part 636 pulls down a voltage of the second node O into the OFF voltage VSS in response to an (n−1)-th carry signal Cr(n−1) that is a carry signal of a previous driving stage and an (n+1)-th gate signal G(n+1) that is a gate signal of a following driving stage. That is, the pull-down part 636 pulls down the n-th gate signal Gn to the OFF voltage VSS.

The inverting part 638 includes a twelfth transistor TR12, a seventh transistor TR7, a thirteenth transistor TR13 and an eighth transistor TR8. The twelfth transistor TR12 includes a control electrode and an input electrode that are coupled to the first clock terminal CT1, and an output electrode coupled to an input electrode of the thirteenth transistor TR13 and to a control electrode of the seventh transistor TR7. An input electrode of the seventh transistor TR7 is coupled to the first clock terminal CT1, and an output electrode of the seventh transistor TR7 is coupled to an input electrode of the eighth transistor TR8. The output electrode of the seventh transistor TR7 is also coupled to a third node N. The inverting part 638 controls a voltage applied to the third node N. The inverting part 638 applies a signal synchronized with the first clock signal CK1 received at first clock terminal CT1. When ON voltage VON is applied at the second node O, the eighth and thirteenth transistors TR8 and TR13 are turned on to discharge the third node N to OFF voltage VSS.

The first maintain part 641 includes a tenth transistor TR10. The tenth transistor TR10 includes a control electrode coupled to the first clock terminal CT1, an input electrode coupled to the first node Q, and an output electrode coupled to the second node O. The first maintain part 641 maintains a voltage of the first node Q at a voltage of the second node O when ON voltage VON is applied at first clock signal CK1.

The second maintain part 642 includes a fifth transistor TR5. The fifth transistor TR5 includes a control electrode coupled to a second clock terminal CT2, an input electrode coupled to the second node O, and an output electrode coupled to power terminal VS. The second maintain part 642 maintains a voltage of the second node O at OFF voltage VSS when ON voltage VON of the second clock signal CK2 is received at the second clock terminal CT2.

The third maintain part 643 includes an eleventh transistor TR11. The eleventh transistor TR11 includes a control electrode coupled to the third node N, an input electrode coupled to the second node O, and an output electrode coupled to the power terminal VS. The third maintain part 643 maintains a voltage of the second node O at OFF voltage VSS in response to an ON voltage VON of the third node N synchronizing with the first clock signal CK1.

Although not shown in FIG. 9, the first and second dummy driving stages according to the present exemplary embodiment can further include a self reset part. The self reset part according to the present exemplary embodiment includes a seventeenth transistor. The seventeenth transistor includes a control electrode coupled to the carry terminal, an input electrode coupled to the first node Q and an output electrode coupled to the power terminal VS. The self reset part discharges the first node Q to the OFF voltage VSS when the carry signal is at ON voltage VON, so that an operation of the self driving stage may be reset.

The gate drive circuit according to the present exemplary embodiment may further include a discharging circuit shown in FIG. 4.

The foregoing is illustrative of the present invention and is not to be construed as limiting thereof. Although a few example embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A gate drive circuit comprising a signal circuit in which a plurality of driving stages is coupled to each other sequentially, the plurality of driving stages outputting a plurality of gate signals to first terminals of a plurality of gate lines, an n-th driving stage, comprising:

a pull-up part configured to output an ON voltage of a first clock signal as an ON voltage of an n-th gate signal, where n is a positive integer;

a carry part configured to output an ON voltage of the first clock signal as an ON voltage of an n-th carry signal;

a first pull-down part configured to pull down an ON voltage of the n-th gate signal into a first OFF voltage in response to at least one output signal of a previous driving stage and at least one output signal of a following driving stage;

a first pull-up/down control part configured to apply a first power signal of an ON voltage to a control terminal of the pull-up part in a forward direction mode, and to apply a first power signal of a second OFF voltage to the control terminal of the pull-up part in a reverse direction mode, in response to the at least one output signal of the previous driving stage;

a second pull-up/down control part configured to apply a second power signal of the second OFF voltage to the control terminal of the pull-up part in the forward direction mode, and to apply the second power signal of the ON voltage to the control terminal of the pull-up part in the reverse direction mode, in response to the at least one output signal of the following driving stage; and an inverting part configured to output the first OFF voltage when the carry part outputs an ON voltage, and to output a signal synchronized with the first clock signal when the carry part outputs the second OFF voltage.

2. The gate drive circuit of claim 1, wherein the second OFF voltage is lower than the first OFF voltage.

3. The gate drive circuit of claim 2, wherein the n-th driving stage further comprises:

a second pull-down part configured to pull down an ON voltage of the n-th carry signal into the second OFF voltage in response to the at least one output signal of the previous driving stages and the at least one output signal of the following driving stage.

4. The gate drive circuit of claim 3, wherein the output signal of the previous driving stage is an ON voltage of a carry signal, and the output signal of the following driving stage is an ON voltage of a carry signal.

5. The gate drive circuit of claim 1, wherein the n-th driving stage further comprises:

a first maintain part configured to maintain a voltage applied to a control terminal of the pull-up part as the second OFF voltage in response to an output signal of the inverting part; and a second maintain part configured to maintain a voltage applied to an output terminal of the carry part as the second OFF voltage in response to the output signal of the inverting part.

6. The gate drive circuit of claim 1, wherein the second OFF voltage is substantially equal to the first OFF voltage.

7. The gate drive circuit of claim 6, wherein the output signal of the previous driving stage is an ON voltage of a carry signal, and the output signal of the following driving stage is an ON voltage of a gate signal.

8. The gate drive circuit of claim 7, wherein the n-th driving stage further comprises:

an inverting part configured to output the first OFF voltage when the pull-up part outputs the ON voltage, and output a signal synchronized with the first clock signal when the pull-up part outputs the first OFF voltage.

9. The gate drive circuit of claim 8, wherein the n-th driving stage further comprises:

a first maintain part configured to maintain a voltage applied to a control terminal of the pull-up part at a voltage applied to an output terminal of the pull-up part in response to the first clock signal;

a second maintain part configured to maintain a voltage applied to an output terminal of the pull-up part at the first OFF voltage in response to a second clock signal; and a third maintain part configured to maintain a voltage applied to an output terminal of the pull-up part at the first OFF voltage in response to an output signal of the inverting part.

10. The gate drive circuit of claim 1, wherein a first driving stage and a last driving stage are driven as a first dummy driving stage and a second dummy driving stage, respectively, and wherein each of the first and second dummy driving stages further comprises a self reset part configured to discharge a voltage applied to a control terminal of the carry part into the second OFF voltage in response to an ON voltage of the n-th carry signal.

11. The gate drive circuit of claim 1, further comprising a discharging circuit comprising a plurality of discharging stages coupled to second terminals of the gate lines, wherein an n-th discharging stage comprises:

a first discharging part configured to discharge an ON voltage of an n-th gate line into the first OFF voltage in response to an (n+1)-th gate line; and a second discharging part configured to discharge an ON voltage of the n-th gate line into the first OFF voltage in response to an ON voltage of an (n−1)-th gate line.

12. A display apparatus, comprising:

a display panel having a display area on which gate lines and data lines are formed to cross with each other to display an image and a peripheral area surrounding the display area;

a main drive circuit configured to generate a first power signal and a second power signal in accordance with a forward direction mode and a reverse direction mode, respectively; and a gate drive circuit including a signal circuit in which a plurality of driving stages are coupled to each other sequentially, the plurality of driving stages outputting a plurality of gate signals to first terminals of the gate lines, wherein an n-th ('n' is a natural number) driving stage comprises:

a pull-up part configured to output an ON voltage of a first clock signal as an ON voltage of an n-th gate signal;

a carry part configured to output the ON voltage of the first clock signal as an ON voltage of an n-th carry signal;

a first pull-down part configured to pull down the ON voltage of the n-th gate signal into a first OFF voltage in response to at least one output signal of a previous driving stage and at least one output signal of a following driving stage;

a first pull-up/down control part configured to apply a first power signal of ON voltage to a control terminal of the pull-up part in a forward direction mode, and to apply the first power signal of second OFF voltage to the control terminal of the pull-up part in a reverse direction mode, in response to at least one output signal of the previous driving stage;

a second pull-up/down control part configured to apply a second power signal of the second OFF voltage to the control terminal of the pull-up part in the forward direction mode, and to apply the second power signal of ON voltage to the control terminal of the pull-up part in the reverse direction mode, in response to at least one output signal of the following driving stage; and an inverting part configured to output the first OFF voltage when carry part outputs an ON voltage, and to output a signal synchronized with the first clock signal when the carry part outputs the second OFF voltage.

13. The display apparatus of claim 12, wherein the second OFF voltage is lower than the first OFF voltage.

14. The display apparatus of claim 13, wherein the n-th driving stage further comprises:

a second pull-down part configured to pull down an ON voltage of the n-th carry signal into the second OFF voltage in response to at least one output signal of the previous driving stage and at least one output signal of the following driving stage.

15. The display apparatus of claim 14, wherein the n-th driving stage further comprises:

a first maintain part configured to maintain a voltage applied to a control terminal of the pull-up part to the second OFF voltage in response to an output signal of the inverting part; and a second maintain part configured to maintain a voltage applied to an output terminal of the carry part into the second OFF voltage in response to an output signal of the inverting part.

16. The display apparatus of claim 12, wherein the second OFF voltage is substantially equal to the first OFF voltage.

17. The display apparatus of claim 16, wherein the n-th driving stage further comprises:

an inverting part configured to output the first OFF voltage when the pull-up part outputs an ON voltage, and outputs a signal synchronized with the first clock signal when the pull-up part outputs the first OFF voltage;

a first maintain part configured to maintain a voltage applied to a control terminal of the pull-up part at a voltage applied to an output terminal of the pull-up part in response to the first clock signal;

a second maintain part configured to maintain a voltage applied to an output terminal of the pull-up part at the first OFF voltage in response to a second clock signal; and a third maintain part configured to maintain a voltage applied to an output terminal of the pull-up part at the first OFF voltage in response to an output signal of the inverting part.

18. The display apparatus of claim 12, wherein each of the first and last driving stages further comprises a self reset part configured to discharge a voltage applied to a control terminal of the carry part to the second OFF voltage in response to an ON voltage of the n-th carry signal.

19. The display apparatus of claim 12, wherein the gate drive circuit further comprises a discharging circuit comprising a plurality of discharging stages coupled to second terminals of the gate lines, wherein an n-th discharging stage comprises:

a first discharging part configured to discharge an ON voltage of an n-th gate line into the first OFF voltage in response to an (n+1)-th gate line; and a second discharging part configured to discharge the ON voltage of the n-th gate line into the first OFF voltage in response to an ON voltage of an (n−1)-th gate line.

* * * * *